US006222568B1

(12) United States Patent
Mano et al.

(10) Patent No.: US 6,222,568 B1
(45) Date of Patent: Apr. 24, 2001

(54) IMAGE FORMING METHOD AND A PRINTER

(75) Inventors: Shigeru Mano, Hino; Eiji Goto, Hachioji, both of (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/349,973

(22) Filed: Jul. 9, 1999

(30) Foreign Application Priority Data

Jul. 10, 1998 (JP) ..... 10-210272

(51) Int. Cl.[7] ..... B41J 2/32
(52) U.S. Cl. ..... 347/171
(58) Field of Search ..... 347/171, 188; 400/120.01, 120.02, 16, 61, 76

(56) References Cited

FOREIGN PATENT DOCUMENTS

05216184 * 8/1993 (JP) .

9-292686 11/1997 (JP) .

* cited by examiner

*Primary Examiner*—N. Le
*Assistant Examiner*—K. Feggins
(74) *Attorney, Agent, or Firm*—Finnegan, Henderson, Farabow, Garrett & Dunner, L.L.P.

(57) ABSTRACT

An image forming apparatus, including: a head, having plural heating elements arranged in line, for forming an image on an image forming medium by transmitting ink, which an ink ribbon has, to the image forming medium; a scanner for moving the heating element in relation to the image forming medium; an input system for inputting image data wherein the image data includes data corresponding to an image; a searcher for searching split lines of the image, according to the image data, so that a space between an edge portion of the image and a discontinued image portion on the image or between a discontinued image portion and its adjoining discontinued image portion is not more than a width of the ink ribbon; and a controller for controlling the head and the scanner so that a portion of the image in the space, between an edge portion of the image and a discontinued image portion on the image or between a discontinued image portion and its adjoining discontinued image portion, is formed by one scanning path of the head.

41 Claims, 3 Drawing Sheets

IMAGE FORMING METHOD AND A PRINTER

BACKGROUND OF THE INVENTION

The present invention relates to an image forming method, and in particular, to a method to form an image from an ink ribbon through thermal transfer.

Since images obtained through photographing by a digital camera can easily be processed on a personal computer, for example, it has become popular that a composite photograph, obtained by a user through addition of arbitrary characters or symbols, is outputted by an ink jet printer or a thermal transfer printer.

On the other hand, high quality images are formed by conventional silver halide photography, and they are used together with digital prints accordingly. Further, there has been developed a technology to form a digital image on a silver halide photograph.

Incidentally, as a prior art to compound characters with images on a silver halide photograph, there is known a technology, for example, wherein images from a negative film and characters are compounded by using a transmission-type original prepared by a computerized photo-typesetting machine. In this technology, however, it is not possible to form characters in a metallic color. If it was possible to form characters by the use of a metallic color on a silver halide photograph, beautiful hybrid images would be obtained from quality images and characters.

To meet this demand, there has been developed a technology to add characters to a silver halide photograph through melt thermal transfer from an ink ribbon (TOKKAIHEI No. 9-292686). This technology makes it possible, for example, to add arbitrary comments in a metallic color, to a silver halide photograph on which an image of a subject is formed.

However, there is a problem which is peculiar to the occasion of forming metallic color images in the technology. For example, when an image is smaller than the width of the ink ribbon, an evaporation layer on the ink ribbon corresponding to that image can be transferred collectively onto a silver halide photograph through melt thermal transfer, which makes it possible to form a flat image that is beautiful like the surface of a polished metal.

On the other hand, when an image is larger than the width of the ink ribbon, an evaporation layer on the ink ribbon corresponding to that image can not be transferred collectively onto a silver halide photograph through melt thermal transfer, which makes it necessary to split the image to be smaller than the ink ribbon width to transfer the image. However, when splicing the split images, there is caused a small step on the spliced portion. This step is as small as about 1 $\mu$m and is hardly sensed when touched, but it is seen as a clear line when the metallic color image is reflected. The line formed on the metallic color image which looks like the surface of the polished metal may deteriorates quality of the image.

On the contrary, when the width of the ink ribbon is made to be larger than the size of the photograph, it seems to be possible to transfer an image to be transferred totally and collectively, and thereby to eliminate the spliced portion on the image. However, an image requiring a total ink ribbon hardly exists, and most images are considered to require only a part of the ink ribbon, which makes ink ribbons to be wasted exceedingly to increase cost of an image. When the width of the ink ribbon is made to be large, on the other hand, there is caused the problem that the thermal head needs to be greater, and the size and cost of a printer are also increased. In addition, there sometimes is an occasion where an ink ribbon needs to be used sparingly.

SUMMARY OF THE INVENTION

In view of the above-mentioned problems generated from the prior art, an object of the invention is to provide an image forming method and a printer which are capable of forming quality characters on an image forming medium, such as photographic paper, at a relatively low cost.

The image forming apparatus and method of the invention attaining the object stated above is represented by: An image forming apparatus, including: a head, having plural heating elements arranged in line, for forming an image on an image forming medium by transmitting ink, which an ink ribbon has to the image forming medium; a scanner for moving the heating element in relation to the image forming medium; an input system for inputting image data wherein the image data includes data corresponding to an image; a searcher for searching split lines of the image, according to the image data, so that a space between an edge portion of the image and a discontinued image portion on the image or between a discontinued image portion and its adjoining discontinued image portion is not more than a width of the ink ribbon; and a controller for controlling the head and the scanner so that a portion of the image in the space, between an edge portion of the image and a discontinued image portion on the image or between a discontinued image portion and its adjoining discontinued image portion, is formed by one scanning path of the head.

The above objective is also achieved by: An image forming apparatus, including: a head, having plural heating elements arranged in line, for forming an image on an image forming medium by transmitting ink, which an ink ribbon has, to the image forming medium; a scanner for moving the head in relation to the image forming medium; an input system for inputting image data wherein the image data includes data corresponding to an image; a splitter for splitting the image into partial images each of which has a horizontal length shorter than a width of the ink ribbon when a horizontal length of the image is longer than the width of the ink ribbon; a controller for controlling the head and the scanner so that each of the partial images is formed with one scanning path of the head; and a moving mechanism for moving the image forming medium in a horizontal direction, in relation to the ink ribbon and the head, for a distance corresponding a horizontal length of each of the partial images.

The above objective is also achieved by: An image forming method, including the steps of: obtaining split lines of the image, according to image data, so that a space between an edge portion of the image and a discontinued image portion on the image or between a discontinued image portion and its adjoining discontinued image portion is not more than a width of the ink ribbon; and forming a portion of the image in the space, between an edge portion of the image and a discontinued image portion on the image or between a discontinued image portion and its adjoining discontinued image portion, by transmitting ink, which an ink ribbon has, to the image forming medium with one scanning path of plural heating elements.

The above objective is also achieved by: An image forming method to transfer an image onto an image forming medium by splitting the image and at least partially melting or softening an ink ribbon, having an evaporated layer, with scanning of a heating element formed in line, including the steps of: splitting the image in a lateral direction into a length, which is not more than a width of the ink ribbon, when a length of the image in the lateral direction is longer than the width of the ribbon so that split images are obtained; forming one of the split images at a time with scanning the heating element in the longitudinal direction of the image; moving the heating element in a reverse direction of a normal scanning direction for an amount of the scanning in the forming step of one of the split images; and shifting the image forming medium for a length corresponding to one of the split images in relation to the heating element and the ink ribbon.

The following are also the preferable embodiments to achieve the above objective.

(1) An image forming method to transfer an image onto an image forming medium by splitting the image and at least partially melting or softening an ink ribbon, having an evaporated layer, with scanning of a head having plural heating elements arranged in line, including the steps of: searching split lines with which a distance between an edge portion of the image and a discontinued image portion the image or a distance between adjoining discontinued image portions is not more than a width of the ink ribbon; determining split lines for splitting the image in accordance with the searched discontinued image portions, and forming an image between the edge portion of the image and the split line for splitting or between the adjoining split lines for splitting.

(2) The image forming method according to above (1) in which when plural discontinued image portions, with which a distance between an edge portion of the image and a discontinued image portion on the image or a distance between adjoining discontinued image portions is not more than a width of the ink ribbon, are searched in the step to determine the split lines for splitting, one of the discontinued image portions with which the distance is closest to the width of the ink ribbon are determined as the split lines for splitting.

(3) A serial type printer in which the image forming method described in (1) or (2) is executed.

(4) An image forming method to transfer an image onto an image forming medium by splitting the image and at least partially melting or softening an ink ribbon, having an evaporated layer, with scanning of a head, having plural heating elements arranged in line, including the steps of: splitting the image in a lateral direction into a length, which is not more than a width of the ink ribbon, when a length of the image in the lateral direction is longer than the width of the ribbon so that split images are obtained; forming one of the split images at a time with scanning the head in the longitudinal direction of the image; moving the head in a reverse direction of a normal scanning direction for an amount of the scanning in the forming step of one of the split images; and shifting the image forming medium for a length corresponding to one of the split images in relation to the head and the ink ribbon.

(5) The image forming method according to above (4) in which the step to split the image has therein a step to search split lines so that a space between an edge portion of the image and a discontinued image portion on the image or between a discontinued image and its adjoining discontinued image is not more than the width of the ribbon, and a step to split the image in accordance with the split lines.

(6) The image forming method according to above (5) in which when plural discontinued images, with which a space between an edge portion of the image and a discontinued image on the image or between a discontinued image and its adjoining discontinued image is not more than the width of the ribbon, are searched in the step to split the image, the image is split at one of the discontinued image portions with which the space is closest to the width of the ink ribbon.

(7) A printer of a serial type in which the image forming method described in either one of (4) to (6) is executed.

(8) The printer according to above (7) in which scanning is carried out in a way that the heating elements are prevented from exceeding edges of the image forming medium.

(9) The image forming method described in either one of (1), (2) and (4) to (6), in which the central surface roughness ($SR_n$) on the obverse side of the image forming medium where an image is formed is not more than 0.10 $\mu$m, and a thickness of the evaporated layer is not less than 100 Å.

(10) The image forming method according to above (9) in which the thickness of the evaporated layer is not more than 2000 Å.

(11) The image forming method according to above (9) or (10), in which the image forming medium is a silver halide photographic photosensitive material having, on its reflection type support, at least one photosensitive layer and at least one nonsensitive layer.

(12) The image forming method according to above (11), in which an image is formed on the photosensitive layer in advance.

(13) The image forming method according to either one of (9) to (12), in which the ink ribbon is composed at least of a base material, a coloring material layer, an evaporated layer and an adhesion layer.

(14) The image forming method according to either one of (9) to (13), in which the evaporated layer is made of aluminum and the coloring material layer has therein yellow coloring materials.

(15) The image forming method according to either one of (9) to (13), in which the evaporated layer is made of aluminum and the coloring material layer is made to be colorless.

(16) The image forming method according to either one of (9) to (12), in which the ink ribbon is composed at least of a base material, an evaporated layer and an adhesion layer.

(17) The image forming method according to either one of (9) to (16), in which the adhesion layer contains resins having therein a hydrophilic group.

The image forming method of the invention having therein a step to detect an edge portion of the image and a split portion of the image, or split portions wherein the distance between them is not more than the width of the ink ribbon, a step to determine split portions for splitting where the image is split, based on the detected split portions, and a step to form an image between the edge portion of the image and the split portion for splitting, or between the split portions for splitting through single scanning of the heating elements makes it possible to prevent spliced portions on an image to the utmost and thereby to maintain quality of images to be high even when images are formed through a plurality of scanning operations.

The image forming method of the invention has therein a step to split the image in the lateral direction to be of the length which is not more than a width of the ink ribbon when the length of the image in its lateral direction is longer than that of the ink ribbon, a step to form one of the split images at a time by moving the heating elements for scanning in the longitudinal direction of the image, a step to move the heating elements in the reverse direction by the amount of the aforesaid scanning, a step to shift the aforesaid photographic paper by a distance corresponding to the lateral length of one of the split images against the heating elements and ink ribbon stated above, and a step to form the succeeding one of the split images at a time by moving the heating elements in the longitudinal direction of the image. For example, in the case of forming an image which is long and slender like a character string, when that image is made to parallel an ink ribbon for transferring, the total image can be formed through single scanning of heating elements, but low rate of utilization of the ink ribbon (printing area of an ink ribbon/ total area of ink ribbon) is feared. Therefore, when the image is split in its longitudinal direction to be within the width of the ink ribbon to conduct the transfer while shifting the heating elements and the ink ribbon, the rate of utilization of the ink ribbon can be greatly improved.

DETAILED DESCRIPTION OF THE INVENTION

Figure 1:
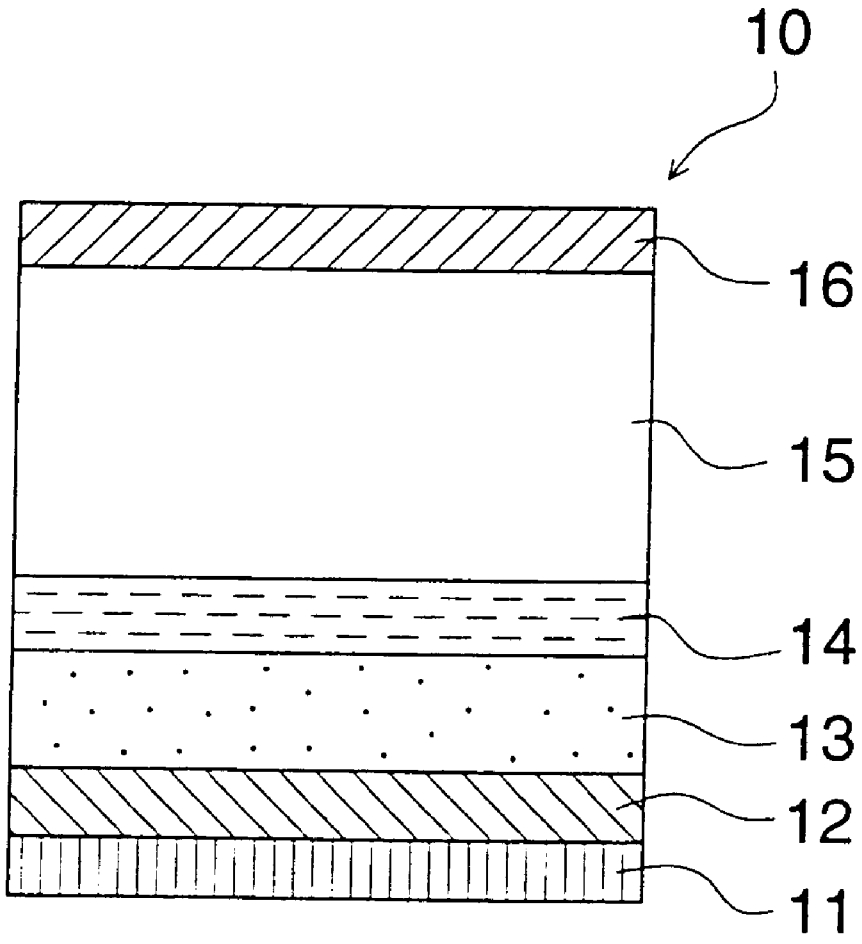
FIG. 1 is a diagram showing a lamination structure of a melt thermal transfer ink ribbon (hereinafter referred to simply as an ink ribbon) related to an embodiment of the invention.

The invention will be explained as follows, referring to an embodiment. FIG. 1 is a diagram showing a laminated structure of a melt thermal transfer ink ribbon (hereinafter referred to simply as an ink ribbon) related to an embodiment of the invention. An ink ribbon is one having on its support melt thermal transfer ink containing resins whose surface layer has a hydrophilic group, and it is one which forms another image on the surface on the side of an image formed on a photosensitive material through exposure and developing, and thereby guarantees sharpness and durability of the melt thermal transfer image. More specifically, in FIG. 1, ink ribbon 10 is structured by superposing adhesive layer 11, thin metal layer 12, colorant layer 13, peeling layer 14, ink ribbon support 15 and heat-resistant layer 16 in this order. Incidentally, the ink ribbon support 15 and the heat-resistant layer 16 constitute a base material.

Resins having therein a hydrophilic group are contained in the colorant layer 13 or the adhesive layer 11 depending on the structure of the ink ribbon. It is preferable that the resins occupy 30% by weight or more of the layer containing the resins, and more preferable is 50% by weight or more. By forming the thin metal layer 12, ink color can be made to be a metallic color, and by making the colorant layer 13 to contain a yellow colorant, it is possible to make it to be close to a gold color and thereby to give a thermal transfer image a gold color which can not yet be attained on a photographic image.

When a gold color of an image in a melt thermal transfer ink satisfies $L \leqq 30$, $-5 \leqq a \leqq +5$, $+0.1 \leqq b \leqq +50$ and glossiness in stipulation of JIS-Z8741-1983 is 100 or more, it is possible to realize gold which gives an impression of high class, and it is practical to form a thin metal layer by evaporating aluminum.

A surface layer (which may be either a colorant layer containing a colorant or a layer having only a function of an adhesive layer) is required to have functions to be melted or softened during thermal transfer to be stuck on a printed photograph, and to make melt thermal transfer ink to be stuck. Therefore, there are used thermoplastic resins and tackifiers, and in either one of them, there is substituted a hydroxyl group, a carboxylic acid group, a sulfonic acid group, an epoxy group or an amino group as a hydrophilic group. A carboxylic acid group, a sulfonic acid group and an amino group to be substituted may be salts.

Listed as thermoplastic resins are polyamide resins, polyester resins, polyacrylate series resins (polymethyl methacrylate, polyethyl acrylate, etc.), polyurethane resins, polyvinyl chloride resins, polyvinylidene chloride resins, polystyrene resins, polyvinyl acetate resins, polyethylene resins, polypropylene resins, polybutadiene resins, polyvinyl alcohol resins, phenol resins, cellulose resins (methyl cellulose, ethyl cellulose, carboxymetyl cellulose, nitrocellulose, etc.), polyvinyl ether resins, polyvinylpyrrolidone resins, petroleum series resins, rosin series resins, coumarin-indene resins, terpene series resins, styrene-butadiene rubber, isoprene rubber, etc. These may be employed individually or in combination of at least two types.

On the other hand, employed as tackifiers can be low molecular weight resins such as low molecular weight polyethylene, rosin, terpene, aliphatic series, aromatic series or dicyclopentadiene series petroleum series resins.

Further, employed as thermally fusible materials can be carnauba wax, montan wax, bees wax, rice wax, paraffin wax, microcrystalline wax, polyethylene wax, sazol wax, lanolin wax, etc. These may be employed individually or in combination of at least two types.

Further, the composition ratio of these thermoplastic resins, tackifiers, and thermally fusible materials is optionally selected, however, preferred ranges are such that thermoplastic resins are between 30 and 100 weight percent, tackifiers are between 0 and 50 weight percent, and thermally fusible materials are between 0 and 55 weight percent. In the present embodiment, adhesive layer 11 is formed employing a composition comprised of 50 weight of a polyacrylic acid ester copolymer (comprising a carboxylic acid group) Jurima AT-510, manufactured by Nihon Junyaku Co., Ltd.), and 50 weight percent of vinyl chloride resin (G351, manufactured by Nippon Zeon Co., Ltd.), and the thickness of layer 11 is adjusted to 0.2 $\mu$m.

Colorant layer 13 is prepared by dispersing a colorant into a composition mainly composed of the above-mentioned thermoplastic resin and tackifier. Colorants include inorganic pigments such as titanium dioxide, carbon black, zinc oxide, Prussian blue, cadmium oxide, chromates of iron oxide, lead, barium, zinc, calcium, etc.; organic pigments such as azo series, thioindigo series, anthraquinone series, anthanthrone series, and triphenedioxazine series pigments, vat color pigments, phthalocyanine pigments, for example, copper phthalocyanines and derivatives thereof, and quinacridone pigments, etc.; dyes such as direct dyes, disperse dyes, oil-soluble dyes, metal-containing oil-soluble dyes, and the like. Specifically, preferred are those which exhibit good light fastness and a minimum decrease in density during storage in the environment. Such colorants may be incorporated into the colorant layer 13 in an amount of 5 to 80 weight percent. In the present embodiment, the colorant layer 13 is prepared by employing a composition composed of 10 weight percent of a yellow dye (Isen Spiron Yellow GRH, manufactured by Hodogaya Kagaku Kogyo Co., Ltd.), 80 weight percent of an acrylic resin (Dianal BR-87, manufactured by Mitsubishi Rayon Co., Ltd.), 5 weight percent of a rosin series resin (Hariester DS90, manufactured by Harima Kasei Co., Ltd.), and 5 weight percent of an ethylene-vinyl acetate copolymer (Soalex R-DH, Nippon Gosei Kagaku Co., Ltd.), and its thickness is adjusted to 1.0 μm.

The thin metal layer (an evaporation layer) 13 can be prepared employing an evaporation method, a sputtering method, an ion-plating method, etc., in which zinc, aluminum, gallium, indium, tin, silver, gold, steel, silicone, chromium, titanium, platinum, vanadium, etc. are used. Further, in the present embodiment, a metallic thin-film layer is explained as the one which is formed by vapor deposition; however, it is possible that such layer is substituted by a layer having metallic particles or a metallic thin-film layer, both formed by applying a solution containing metallic particles. A layer thickness of about 10 to about 200 mm is considered to be effective. However, because the thickness markedly affects print quality, an appropriate value should be determined according to the test described later.

Peeling layer 14 is provided to maintain an appropriate level of sensitivity so that only the heated part is effectively transferred and also to improve the sharpness of melt thermal transfer images. Natural wax, paraffin wax, microline wax, wax oxide, ester wax, synthetic wax such as low molecular weight polyethylene, etc. may be employed, and of these, high melting point polyethylene wax is particularly preferred. In order to adjust the adhesion force to a support, resins or additives may be incorporated. In the present embodiment, the peeling layer 14 is prepared employing a composition composed of 90 weight percent of a high melting point polyethylene wax (Microflat CE-150, manufactured by Koyo Kagaku Co., Ltd.) and 10 weight percent of an ethylene-vinyl acetate copolymer (Everfilex EV210, manufactured by Mitsui-Du Pont Polychemical Co., Ltd.) and its thickness is adjusted to 0.4 μm.

There is no particular limitation on support 15. Upon referring to practiced situations, etc., a support may be selected from those of various materials, layer structures, and sizes, and thus employed. Listed as supports can be, for example, various types of papers such as plain paper, coated paper, synthetic paper (polypropylene, polystyrene, or composite materials prepared by laminating these onto paper); various types of single layer films or sheets such as vinyl chloride series resin sheets, ABS resin sheets, polyethylene terephthalate base film, polybutylene terephthalate base film, polyethylene naphthalate base film, polyarylate base film, polycarbonate base film, polyether ketone, polysulfone base film, polyethersulfone base film, polyether imide base film, polyimide base film, etc., or at least doubly laminated films or sheets thereof; films or sheets formed employing various metals; films or sheets formed employing various ceramics, or composite materials prepared by laminating suitable combinations selected from those described above.

The thickness of support 15 is 20 μm or less, and it preferably is 2–10 μm. Further, on the reverse side (opposite to the ink layer) of the support 15, there is provided heat-resistant layer 16 to prevent occurrence of fusion, sticking and blocking of thermal head 20 to the support 15 and occurrence of creases of ink ribbon 10. In the present embodiment, the support is made of polyethylene terephthalate (PET) with a thickness of 5.0 μm having on its reverse side heat-resistant layer 16 with a thickness of 0.2 μm.

Figure 2:
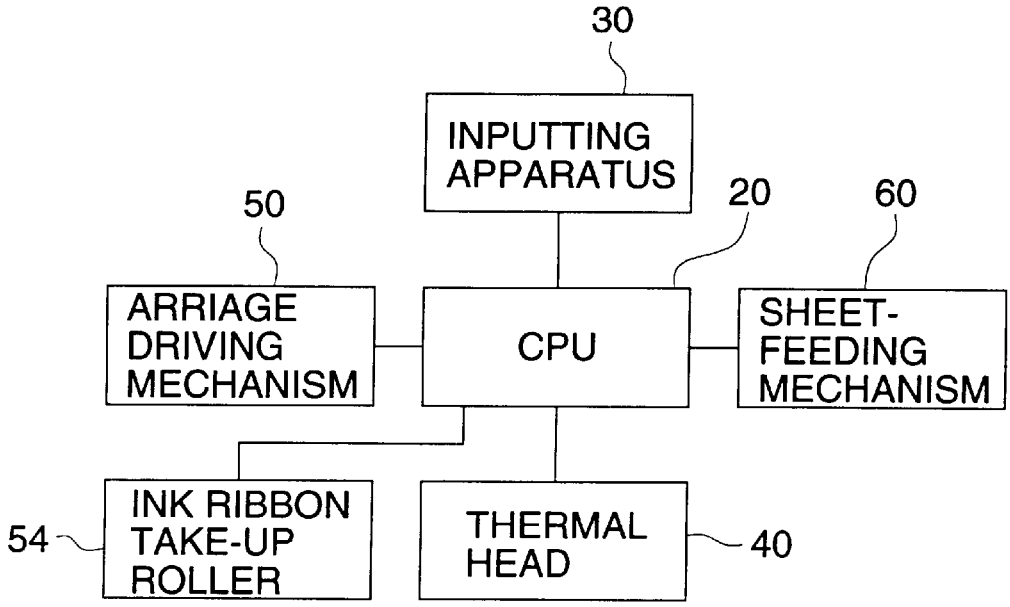
FIG. 2 is a block diagram showing the structure of a printer related to the present embodiment.
Figure 3:
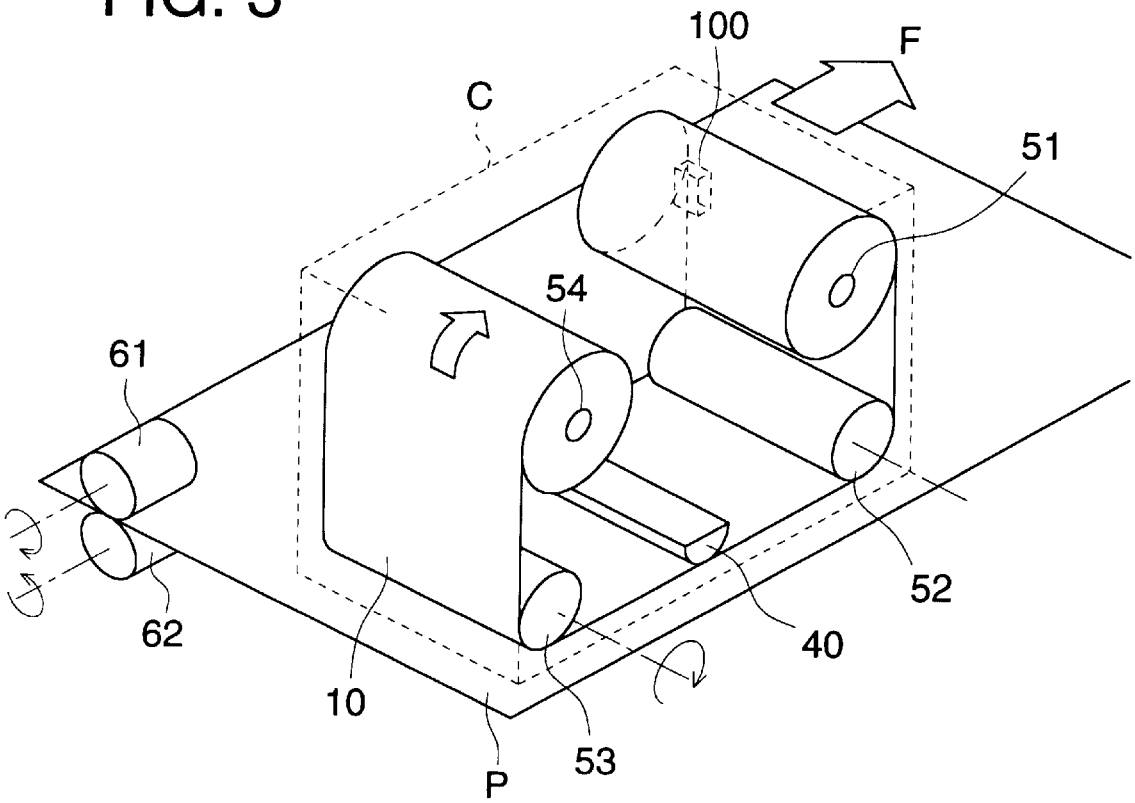
FIG. 3 is a perspective view of a cartridge housing therein an ink ribbon.

FIG. 2 is a block diagram showing the structure of a printer related to the present embodiment, while FIG. 3 is a perspective view of a cartridge housing therein an ink ribbon. In FIG. 2, CPU 20 inputs, from input apparatus 30 such as a key board or a scanner, the data (digital data of an image, transfer coordinates etc.) related to the image to be transferred. Based on the data, CPU 20 further sets a photographic paper at a prescribed position by driving sheet-feeding mechanism 60, and it further controls driving of thermal head 40 while synchronizing with carriage driving mechanism 50 to transfer an evaporation layer of ink ribbon 10 onto the photographic paper. After completion of the transfer, CPU 20 controls sheet-feeding mechanism 60 to move the photographic paper.

In FIG. 3, cartridge C for an ink ribbon which is shown with no body is placed on photographic paper P. Semi-cylindrical thermal head 40 is provided, on its bottom end, with 480-dot heating elements arranged to form a line in the present embodiment, and the side of the heat-resistant layer 16 of ink ribbon 10 can be heated.

Ink ribbon 10 is supplied from supply roller 51 to thermal head 40 through guide roller 52 in cartridge C, and is further taken up by take-up roller 54 through guide roller 53.

Next, operations of a printer in the present embodiment will be explained as follows. First, when transferring a horizontal type image like English onto photographic paper P, CPU 20 controls carriage driving mechanism 50 to move thermal head 40 together with cartridge C in the direction of arrow mark F in FIG. 3, while repeating partial heating and non-heating on the thermal head 40. This operation is called scanning. In this case, ink ribbon 10 is kept to be under the condition that it is fixed against photographic paper P.

In that case, peeling layer 14 (FIG. 1) of ink ribbon 10 is melted or softened to be peeled off in accordance with an image, and when adhesive layer 11 is stuck to the surface of photographic paper P, an image such as a gold character which is excellent in durability is formed. When an image is of a horizontal type, it is possible to conduct melt thermal transfer while taking up ink ribbon 10, in response to movement of cartridge C, which makes it possible to form an image having no split portion through single scanning of the thermal head, provided that the ink ribbon 10 does not arrive at its end portion.

Figure 4:
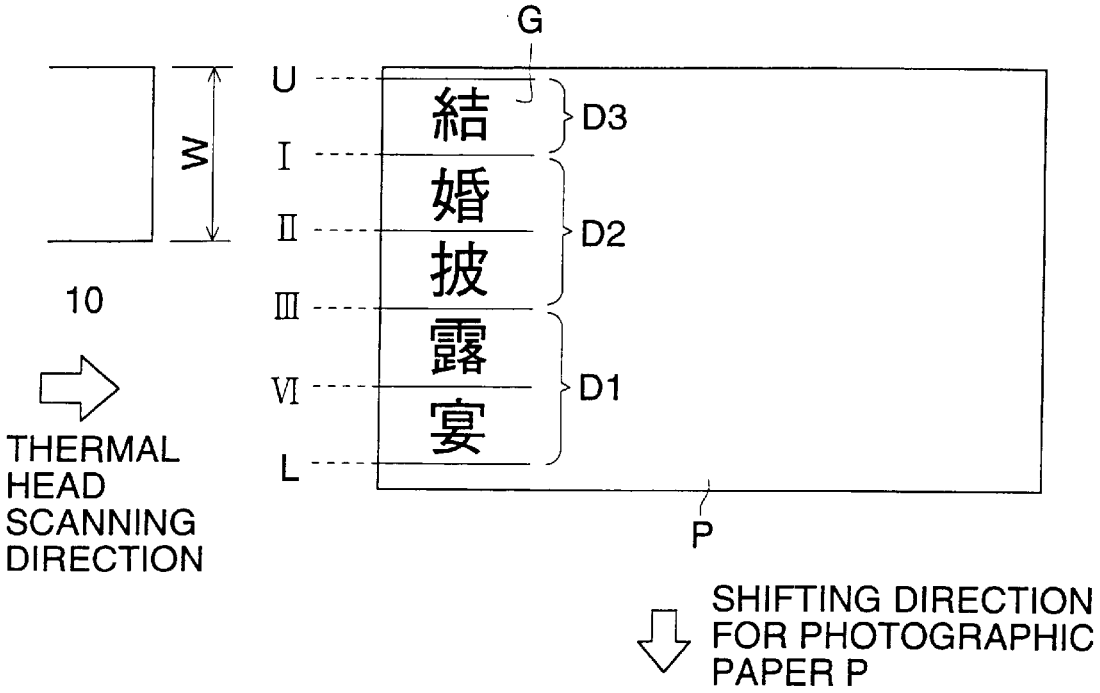
FIG. 4 is a diagram showing an example of transferred characters.

On the other hand, as shown in FIG. 4, when forming a vertical type image, it is not possible to form all images of "結婚披露宴" through single scanning of a thermal head, which makes it necessary to split the image and to conduct melt thermal transfer. As stated above, however, if melt thermal transfer is conducted in a way to generate spliced portions on the image, lines are caused on the spliced portions and printing quality is lowered. In the present embodiment, therefore, printing quality is kept high in the following way.

First of all, CPU 20 searches a split portion of an image for the image to be transferred. For example, a sequential image data where pixels are not linked together (a discontinued image portion) in the scanning direction of the thermal head is searched from image data to be transferred inputted from inputting apparatus 30. Namely, the sequential image data where all data are NULL data in the scanning direction of the thermal head is searched. With regard to character image G saying "結婚披露宴" shown in FIG. 4, four discontinued image portions I, II, III and IV are searched.

Next, CPU 20 compares width W of ink ribbon 10 respectively with a distance between the upper end of image G and a discontinued image portion, a distance between two discontinued image portions, and a distance between a discontinued image portion and a lower end, and determines the split portions for division so that an image may be formed through least scanning operations.

To be more concrete, image G is split on split portion I which is the first from the top, and image G is further split on split portion III which is the third from the top so that the image G is divided into three zones D1, D2 and D3. After that, CPU 20 transfers zone D1 "露宴" through the first scanning of the thermal head, then returns cartridge C to its original position, and shifts photographic paper P by an amount equivalent to two characters by using rollers 61 and 62 of sheet-feeding apparatus 60 (FIG. 3). Incidentally, by storing width W of ink ribbon 10 in advance, it is possible to search split portions wherein all of the distance between the upper end of image G and the split portion, the distance between two split portions, and the distance between the split portion and the lower end are smaller than width W of ink ribbon 10 and are closest to width W, without searching all split portions.

Further, zone D2 "婚披" is transferred through the second scanning of the thermal head, and cartridge C is returned to its original position. Now, shifting of photographic paper P is needed prior to the third scanning. However, if it is shifted by an amount equivalent to two characters, the thermal head 40 is positioned to be protruded from the upper end of photographic paper P by a half thereof. If melt thermal transfer is conducted under such condition, the thermal head 40 is tilted from the surface of photographic paper P and quality prints can not be obtained.

Therefore, CPU 20 detects the upper end of photographic paper P based on the size of the photographic paper P contained in data which were inputted in the first place, and thereby shifts the photographic paper P to the position where it is not projected, namely, by an amount equivalent to one character, then, zone D3 "結" is transferred through the third scanning of the thermal head, thus, forming of image G is completed. In the present embodiment, CPU 20 automatically searches split portions of an image, and the image is split so that it may be formed most efficiently from a viewpoint of the rate of utilization of time and the ink ribbon as stated above, which makes it possible to form efficiently high quality images.

Incidentally, when CPU 20 fails to search split portions on an image within a range of a width of ink ribbon 10, the image is split, for the time being, at the position which is close to the width of ink ribbon 10, and melt thermal transfer is conducted. In that case, a spliced portion is caused on the image, but the excellent rate of utilization of an ink ribbon can be kept. It is also possible to form an image through five scanning operations by splitting image G at all of split portions I–IV.

With regard to a horizontal type image such as English, it can be formed without split portions provided that the ink ribbon does not come to an end, as stated above. In that case, it is rare that the evaporation layer covering the full width of the ink ribbon is transferred, which makes the rate of utilization of the ink ribbon to be extremely poor. In the example of variation which will be explained as follows, it is possible to improve the rate of utilization of an ink ribbon while keeping quality of images to be high.

Figure 5:
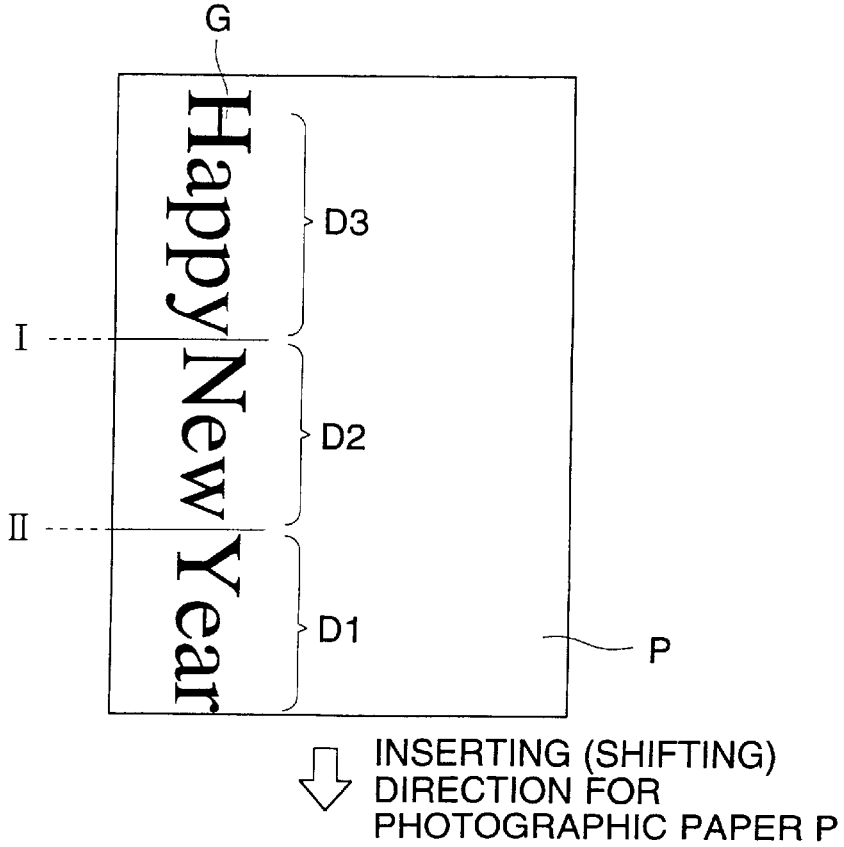
FIG. 5 is a diagram showing an example of transferred characters.

In FIG. 5, let it be assumed that character image P to be transferred is placed to be extended in the longitudinal direction of photographic paper P. In that case, the direction in which a sheet is fed to the printer by sheet-feeding apparatus 60 (FIG. 2) is made to be different by 90° from the direction in the embodiment shown in FIG. 4, namely, photographic paper P is inserted in the printer with an end portion of the photographic paper P in its longitudinal direction being a leading edge.

Incidentally, judgment whither or not to change the scanning direction of the thermal head by 90° for the image may either be made by an operator who operates the printer by inputting a command from the inputting apparatus such as a dey board, or be made automatically by CPU 20 in accordance with information of an image size of image data related to images to be transferred inputted from the inputting apparatus 30 and a width of ink ribbon 10.

Now, with regard to character image G shown in FIG. 5 wherein "Happy New Year" is written vertically, CPU 20 searches two split portions, I and II. Then, CPU 20 splits image G into three zones Dl, D2 and D3 on split portions I and II. After that, CPU 20 transfers zone D1 "Year" through the first scanning of the thermal head, then, returns cartridge C to its original position and shifts photographic paper P by the use of rollers 61 and 62 of sheet-feeding apparatus (FIG. 3).

Then, CPU 20 conducts the second and third scanning operations of the thermal head in the same procedures, and conducts melt thermal transfer for each of zone D2 "New" and zone D3 "Happy" in succession to complete the image. In the present variation, therefore, consumption of the ink ribbon is only an amount equivalent to about three times plus a the length of image G in its lateral direction, when an amount of ink ribbon 10 equivalent to the length of image G in its longitudinal direction should be consumed in another case.

Next, there will be explained another example, in which the only points which are different from those in the embodiment stated above will be explained.

The numeral 100 in FIG. 3 represents a sensor which detects a terminal of an ink ribbon.

When transfer of image data which is being conducted currently by thermal head 40 is completed after the detection of a terminal of an ink ribbon carried out by the sensor 100, CPU 20 discontinues the transfer of image data. Then, the CPU 20 outputs a control signal for indicating replacement of an ink ribbon. Then, based on the control signal, a command for replacement of an ink ribbon is displayed on an unillustrated display unit which is provided on a printer. The command for replacement of an ink ribbon may also be, for example, of the structure to produce a warning sound. By doing this, it is possible to reduce splicing lines on an image by replacing an ink ribbon on the half way in a series of image recording.

Further, after the sensor 100 detects a terminal of an ink ribbon, CPU 20 compares a size of data in the longitudinal direction of an ink ribbon for images to be recorded in the following scanning with a length of the remaining ribbon, and when the length of the remaining ribbon is not smaller than the size of the image data, image recording is conducted in the following scanning, while when the length of the remaining ribbon is smaller than the size of the image data, a control signal like that in the foregoing to indicate replacement of an ink ribbon is outputted after completion of image data recording which is currently conducted.

By doing this, it is possible not only to reduce splicing lines on an image but also to reduce waste of ribbons.

It is also possible to arrange so that CPU 20 splits image data to be recorded in the following scanning, in accordance with a length of the remaining ribbon, after the sensor 100 detects a terminal of an ink ribbon. Namely, a length of the remaining ribbon is compared with a size of image data located between two adjoining split lines on an image or with a size of image data located between an image edge and a split line on an image, and split lines for splitting an image which make the split area to be not more than a length of the remaining ink ribbon are searched. By doing this, it is possible to further reduce waste of ink ribbons.

Silver halide photosensitive photographic material P (hereinafter also referred to as photosensitive material) comprising a reflective support having thereon a photosensitive silver halide emulsion layer (a photographic image surface) is for direct viewing use, and so-called print photographs are prepared through exposure and development.

In order to adjust, to no more than 10 $\mu$m, the roughness $SR_n$ of the resin layer surface of the photographic support having polyolefin resin onto which a silver halide photosensitive layer is applied, it is required to adjust the melt coating weight of a polyolefin resin composition on a paper support to at least 40 g/m$^2$ and the coating weight is preferably between 40 to 100 g/m$^2$. The more increase in the resin weight per unit area in the resin composition layer than the above described is limited in terms of cost and the like.

On the other hand, as a method to adjust to no more than 0.10 $\mu$m the surface roughness $SR_n$ of the resin layer of a photographic support onto which a silver halide photosensitive layer is applied, there is one in which the melt extrusion coating weight of a polyolefin resin composition is adjusted to 40 g/m$^2$. In addition to the above-mentioned method, there is a photographic support which is prepared by employing a method in which, after coating polymerizable monomers, etc., hardening is carried out by irradiating an electron beam to the resultant layer, that is, a photographic support employing a so-called electron-beam curable resin. This method makes it possible to more readily decrease the $SR_n$ and is the one used to obtain a more preferable photographic support for the present invention.

More specifically, in the present example, high density polyethylene is laminated onto both surfaces of paper pulp having a weight of 180 g/m$^2$, and a paper support was thus prepared. However, melted polyethylene containing 15 weight percent of surface-treated anatase-type titanium oxide was laminated onto the surface onto which an emulsion layer was subsequently applied, and a reflective support was thus prepared. The resultant reflective support was subjected to corona discharge treatment, and a gelatin sublayer was then provided. Further, each layer having the composition described below was coated and a silver halide photosensitive photographic material was thus prepared. Further, coating compositions were prepared as described below.

First Layer Coating Composition

Added to 23.4 g of a yellow coupler (Y-1), 3.34 g of a dye image stabilizer (ST-1), 3.34 g of a dye image stabilizer (ST-2), 3.34 g of a dye image stabilizer (ST-5), 0.34 g of an antistaining agent (HQ-1), 5.0 g of image stabilizer A, 3.33 g of a high boiling point organic solvent (DBP), and 1.67 g of high boiling point organic solvent (DNP) were 60 ml of ethyl acetate, and these were then allowed to dissolve. The resultant solution was emulsify-dispersed into 220 ml of a 10% aqueous gelatin solution comprising 7 ml of a 20% surface active agent (SU-1) solution employing an ultrasonic homogenizer, and a yellow coupler dispersion was thus prepared. The resultant dispersion was mixed with a blue-sensitive silver halide emulsion prepared under the conditions described below, to prepare a first layer coating composition.

Each coating composition of the second layer coating composition to the seventh layer coating composition was prepared in the same manner as the first layer coating composition so that coating weights were obtained as shown in the list described below.

Furthermore, (H-1) and (H-2) were added as hardeners. As a coating aid, surface active agent (SU-1) was added to adjust the surface tension. Furthermore, F-1 was added to each layer so that the total weight was 0.04 g/m$^2$.

| | Added Amount (g/m$^2$) |
|---|---|
| 7th Layer <Protective Layer> | |
| Gelatin | 1.00 |
| DIDP | 0.002 |
| DBP | 0.002 |
| Silicone dioxide | 0.003 |
| 6th Layer <UV Absorbing Layer> | |
| Gelatin | 0.40 |
| AI-1 | 0.01 |
| UV absorber (UV-1) | 0.12 |
| UV absorber (UV-2) | 0.04 |
| UV absorber (UV-3) | 0.16 |
| Antistaining agent (HQ-5) | 0.04 |
| PVP | 0.03 |
| 5th Layer <Red-sensitive Layer> | |
| Gelatin | 1.30 |
| Red-sensitive silver chlorobromide emulsion (Em-R) | 0.21 |
| Cyan coupler (C-1) | 0.25 |
| Cyan coupler (C-2) | 0.04 |
| Cyan coupler (C-3) | 0.04 |
| Dye image stabilizer (ST-1) | 0.10 |
| Antistaining agent (HG-1) | 0.004 |
| DBP | 0.10 |
| DOP | 0.20 |
| 4th Layer <UV Absorbing Layer> | |
| Gelatin | 0.94 |
| UV absorber (UV-1) | 0.28 |
| UV absorber (UV-2) | 0.09 |
| UV absorber (UV-3) | 0.38 |
| AI-1 | 0.02 |
| Antistaining agent (HQ-5) | 0.10 |
| 3rd Layer <Green-sensitive Layer> | |
| Gelatin | 1.30 |
| AI-2 | 0.01 |
| Green-sensitive silver chlorobromide emulsion (Em-G) | 0.14 |
| Magenta coupler (M-1) | 0.15 |
| Magenta coupler (M-2) | 0.05 |
| Dye image stabilizer (ST-3) | 0.20 |
| Dye image stabilizer (ST-4) | 0.17 |
| DIDP | 0.13 |
| DBP | 0.13 |
| 2nd Layer <Interlayer> | |
| Gelatin | 1.20 |
| AI-3 | 0.01 |
| Antistaining agent (HQ-2) | 0.03 |
| Antistaining agent (HQ-3) | 0.03 |
| Antistaining agent (HQ-4) | 0.05 |
| Antistaining agent (HQ-5) | 0.23 |
| DIDP | 0.04 |
| DBP | 0.02 |
| Fluorescent whitening agent (W-1) | 0.10 |
| 1st Layer <Blue-sensitive Layer> | |
| Gelatin | 1.20 |
| Blue-sensitive silver chlorobromide emulsion (Em-B) | 0.26 |
| Yellow coupler (Y-1) | 0.30 |
| Yellow coupler (Y-2) | 0.20 |
| Yellow coupler (Y-3) | 0.10 |
| Dye image stabilizer (ST-1) | 0.10 |

-continued

| | Added Amount (g/m$^2$) |
|---|---|
| Dye image stabilizer (ST-2) | 0.10 |
| Dye image stabilizer (ST-5) | 0.10 |
| Antistaining agent (HQ-1) | 0.01 |
| Image stabilizer A | 0.15 |
| DNP | 0.05 |
| DBP | 0.15 |

Support: photographic support B or G described in Japanese Patent Publication Open to Public Inspection No. 7-319114. Further, the added amount of a silver halide emulsion was described in terms of silver.

SU-1: sodium tri-i-propylnaphthalenesulfonate

DBP: dibutyl phthalate

DNP: dinonyl phthalate

DOP: dioctyl phthalate

DIDP: di-i-decyl phthalate

PVP: polyvinylpyrrolidone

H-1: tetrakis(vinylsulfonylmethyl)methane

H-2: 2,4-dichloro-6-hydroxy-s-triazine sodium

HQ-1: 2,5-di-octylhydroquinone

HQ-2: 2,5-di-sec-dodecylhydroquinone

HQ-3: 2,5-di-sec-tetradecylhydroquinone

HQ-4: 2-sec-dodecyl-5-sec-tetradecylhydroquinone

HQ-5: 2,5-di[(1,1-dimethyl-4-hexyloxycarbonyl)butyl] hydroquinone

Image stabilizer A: P-t-octylphenol

Y-1

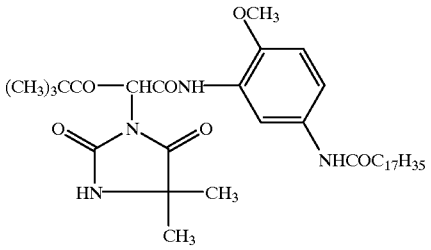

Y-2

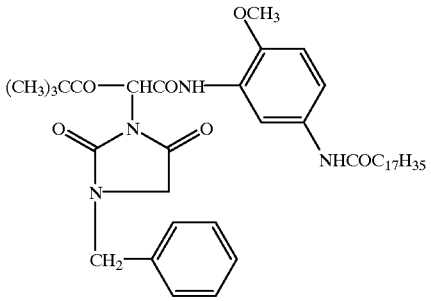

Y-3

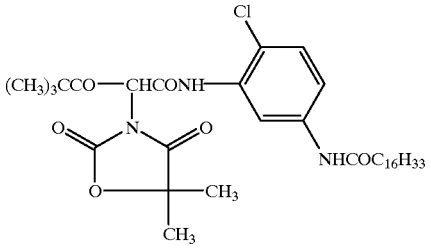

C-1

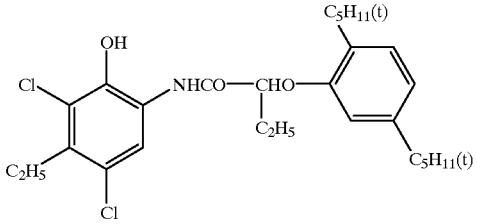

C-2

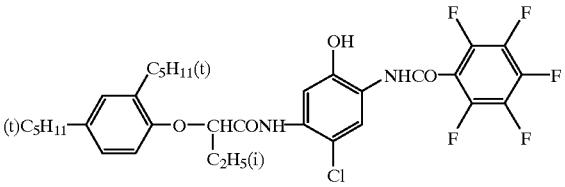

C-3

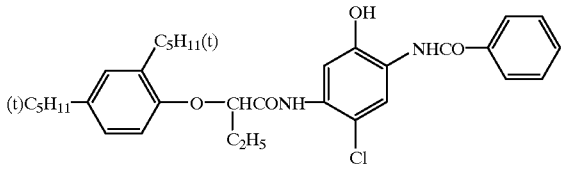

M-1

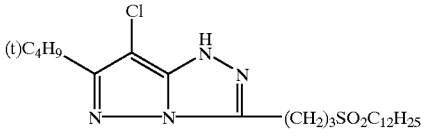

M-2

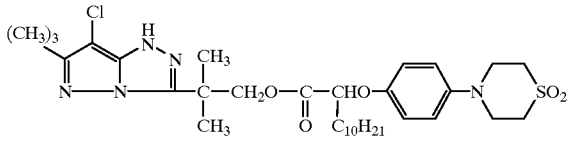

ST-1

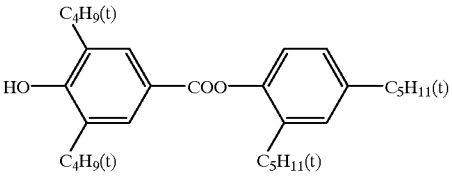

ST-2

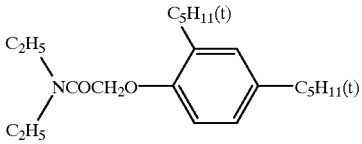

-continued

ST-3

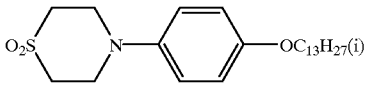

ST-4

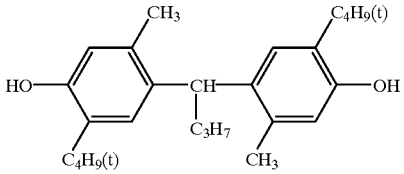

ST-5

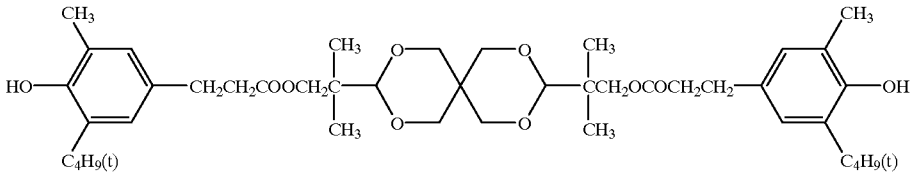

UV-1

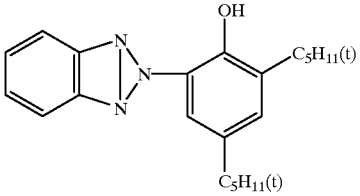

UV-2

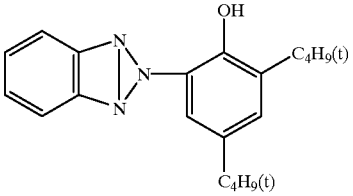

UV-3

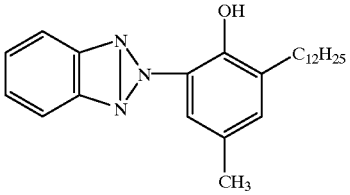

Al-1

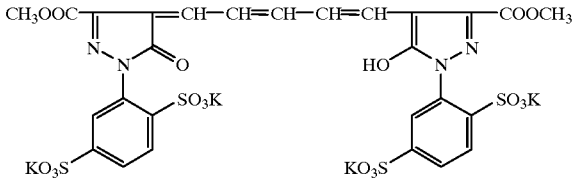

Al-2

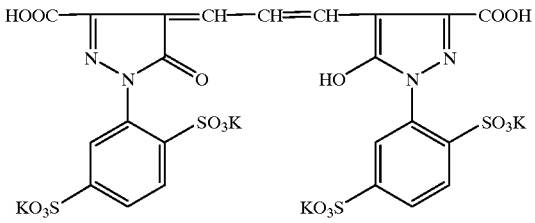

Al-3

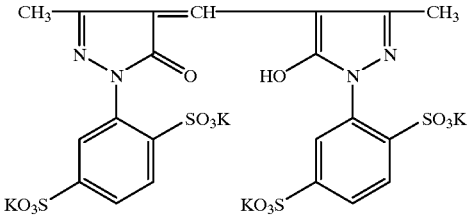

W-1

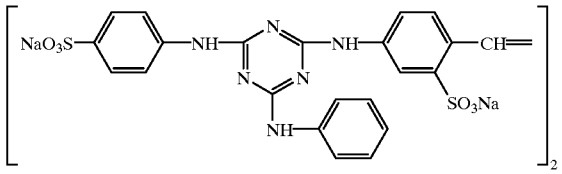

F-1

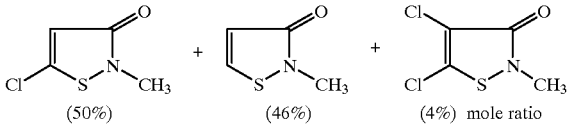

(50%) (46%) (4%) mole ratio (Preparation of the Blue-sensitive Silver Halide Emulsion)

Simultaneously added over 30 minutes, to one liter of a 2% aqueous gelatin solution maintained at 40° C. were (Solution A) and (Solution B) described below while adjusting the pAg and pH to 7.3 and 3.0, respectively, and were then (Solution C) and (Solution D) over 180 minutes, while adjusting the pAg and pH to 8.0 and 5.5, respectively. During these periods, the pAg was adjusted employing a method described in Japanese Patent Publication Open to Public Inspection No. 59-45437, and the pH was adjusted employing an aqueous sulfuric acid or sodium hydroxide solution.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |

-continued

| | |
|---|---|
| (Solution C) | |
| Sodium chloride | 102.7 g |
| $K_2IrCl_6$ | $4 \times 10^{-8}$/mole Ag |
| $K_4Fe(CN)_6$ | $2 \times 10^{-5}$/mole Ag |
| Potassium bromide | 1.0 g |
| Water to make | 600 ml |
| (Solution D) | |
| Silver nitrate | 300 g |
| Water to make | 600 ml |

After completing the addition, desalting was carried out employing a 5% aqueous solution of Demol N manufactured by Kao Atlas Co. and a 20% aqueous magnesium sulfate solution. An aqueous gelatin solution was then mixed to obtain monodisperse cubic grain emulsion EMP-1 having an average grain diameter of 0.71 μm, a variation coefficient of the grain distribution of 0.07, and a content ratio of silver chloride of 99.5 mole percent. Subsequently, a monodisperse cubic grain emulsion having an average grain diameter of 0.66 μm, a variation coefficient of the grain distribution of 0.07, and a content ratio of silver chloride of 99.5 mole percent was prepared in the same manner as EMP-1, except that the addition time of (Solution A) and (Solution B), and the addition time of Solution (C) and Solution (D) were varied.

The above-mentioned EMP-1 underwent optimal chemical sensitization at 60° C. employing the compounds described below. In the same manner, the EMP-1B underwent optimal chemical sensitization. Thereafter, the sensitized EMP-1 and EMP-1B were mixed in a ratio of 1:1 in terms of silver weight to prepare a blue-sensitive emulsion (Em-B).

| | |
|---|---|
| Sodium thiosulfate | 0.8 mg/mole AgX |
| Chloroauric acid | 0.5 mg/mole AgX |
| Stabilizer STAB-1 | $3 \times 10^{-4}$ mole/mole AgX |
| Stabilizer STAB-2 | $3 \times 10^{-4}$ mole/mole AgX |
| Stabilizer STAB-3 | $3 \times 10^{-4}$ mole/mole AgX |
| Sensitizing dye BS-1 | $4 \times 10^{-4}$ mole/mole AgX |
| Sensitizing dye BS-2 | $1 \times 10^{-4}$ mole/mole AgX |

(Preparation of the Green-sensitive Silver Halide Emulsion)

A monodisperse cubic grain emulsion EMP-2 having an average grain diameter of 0.40 μm, a variation coefficient of 0.08, and a content ratio of silver chloride of 99.5 mole percent was prepared in the same manner as EMP-1, except that the addition time of (Solution A) and (Solution B), and the addition time of (Solution C) and (Solution D) were varied. Subsequently, monodisperse cubic grain emulsion EMP-2B having an average grain diameter of 0.50 μm, a variation coefficient of 0.08, and a content ratio of silver chloride of 99.5 mole percent was prepared.

The above-mentioned EMP-2 underwent optimal chemical sensitization at 55° C. employing the compounds described below. In the same manner, the EMP-2B underwent optimal chemical sensitization. Thereafter, the sensitized EMP-2 and EMP-2B were mixed at a ratio of 1:1 in terms of silver weight to prepare a green-sensitive emulsion (Em-G).

| | |
|---|---|
| Sodium thiosulfate | 1.5 mg/mole AgX |
| Chloroauric acid | 1.0 mg/mole AgX |
| Stabilizer STAB-1 | $3 \times 10^{-4}$ mole/mole AgX |
| Stabilizer STAB-2 | $3 \times 10^{-4}$ mole/mole AgX |
| Stabilizer STAB-3 | $3 \times 10^{-4}$ mole/mole AgX |
| Sensitizing dye GS-1 | $4 \times 10^{-4}$ mole/mole AgX |

(Preparation of the Red-sensitive Silver Halide Emulsion)

A monodisperse cubic grain emulsion EMP-3 having an average grain diameter of 0.40 μm, a variation coefficient of 0.08, and a content ratio of silver chloride of 99.5 mole percent was prepared in the same manner as EMP-1, except that the addition time of (Solution A) and (Solution B), and the addition time of (Solution C) and (Solution D) were varied. A monodisperse cubic grain emulsion EMP-3B having an average grain diameter of 0.38 μm, a variation coefficient of 0.08, and a content ratio of silver chloride of 99.5 mole percent was thus prepared.

The above-mentioned EMP-3 underwent optimal chemical sensitization at 60° C. employing the compounds described below. In the same manner, the EMP-3B underwent optimal chemical sensitization. Thereafter, the sensitized EMP-3 and EMP-3B were mixed in a ratio of 1:1, in terms of silver weight, to prepare a red-sensitive emulsion (Em-R).

| | |
|---|---|
| Sodium thiosulfate | 1.8 mg/mole AgX |
| Chloroauric acid | 2.0 mg/mole AgX |
| Stabilizer STAB-1 | $3 \times 10^{-4}$ mole/mole AgX |
| Stabilizer STAB-2 | $3 \times 10^{-4}$ mole/mole AgX |
| Stabilizer STAB-3 | $3 \times 10^{-4}$ mole/mole AgX |
| Sensitizing dye RS-1 | $1 \times 10^{-4}$ mole/mole AgX |
| Sensitizing dye RS-2 | $1 \times 10^{-4}$ mole/mole AgX |

STAB-1: 1-(3-acetamidophenyl)-5-mercaptotetrazole
STAB-2: 1-phenyl-5-mercaptotetrazole
STAB-3: 1-(4-ethoxyphenyl)-5-mercaptotetrazole Furthermore, SS-1 was added to the red-sensitive emulsion in an amount of $2.0 \times 10^{-3}$ mole per mole of silver halide.

BS-1

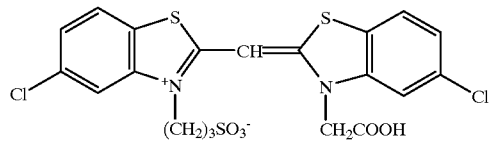

BS-2

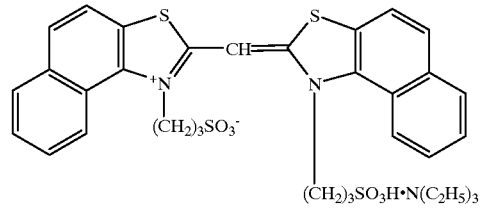

-continued

GS-1

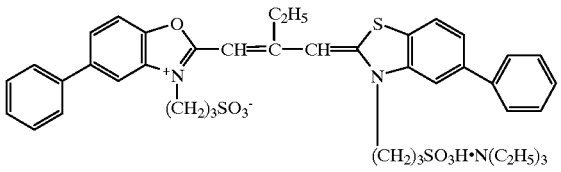

RS-1

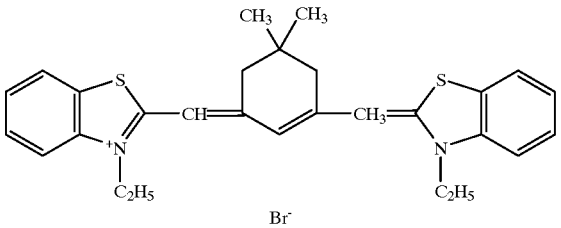

RS-2

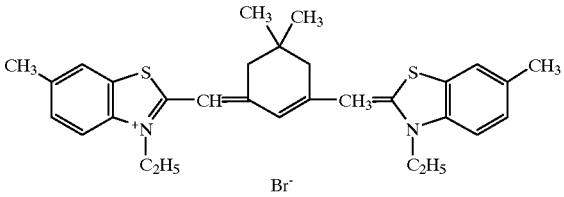

SS-1

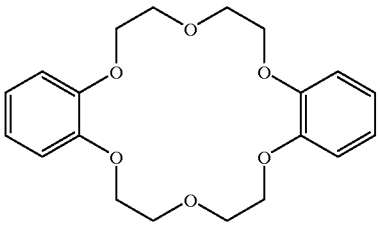

In such a manner, photographic paper P was prepared.

Tests were carried out to evaluate variations of print quality for cases in which the surface roughness of photosensitive material P was varied, as well as in which the thickness of evaporation layer 13 of ink ribbon 10 was varied. First, the average roughness ($SR_n$) of the center surface of photosensitive material P is defined as follows.

$$SR_a = (1/S_A) \cdot \int_0^{Lx} \int_0^{Ly} |f(x, y)| dx dy$$

Herein, in the formula:

$SR_n$ represents the average roughness of the center surface area

Lx represents the length in the X axis direction of the measured surface area

Ly represents the length in the Y axis direction of the measured surface area $S_A$ represents the area of the measured surface, that is, $S_A$=Lx×Ly f(x, y) represents the surface unevenness at position coordinates (x, y).

In the present embodiment, three types of photosensitive materials P, in which the surface roughness was adjusted to 0.20, 0.10, and 0.07 μm, respectively, were prepared. Text images and the like were formed in the embodiment shown in FIG. 2 by melt thermal transfer employing five types of ink ribbons 10 having an evaporated layer at a thickness of 80, 100, 500, 1,000, and 2,000 Angstrom. The resultant images were visually observed employing a magnifying lens at a 20 power magnification, and the edge gradient was evaluated. Further, glossiness was measured at an incidence angle of 45° and an acceptance angle of 45° employing a gloss meter VGS-1D manufactured by Nihon Denshoku Kogyo Co., Ltd. in accordance with JIS-Z8741-1983. The results were evaluated employing the criteria as follows: very good was represented by A, good was represented by B, and poor was represented by C. Table 1 shows the results.

TABLE 1

| Surface Roughness | | | 0.20 | 0.10 | 0.07 |
|---|---|---|---|---|---|
| Thickness of Evaporation Layer | 80 Angstrom | Glossiness | C | C | C |
| | | Edge Gradient | C | B | A |
| | 100 Angstrom | Glossiness | C | B | A |
| | | Edge Gradient | C | B | A |
| | 500 Angstrom | Glossiness | C | B | A |
| | | Edge Gradient | C | B | A |
| | 2000 Angstrom | Glossiness | C | B | A |
| | | Edge Gradient | C | B | A |
| | 3000 Angstrom | Glossiness | C | B | A |
| | | Edge Gradient | C | C | C |

C: poor
B: good
A: very good

As is apparent from Table 1, in the case of a photosensitive material with a surface roughness of 0.20 μm, both glossiness and edge gradient were evaluated to be poor regardless of the thickness of the ink ribbon evaporation layer. On the other hand, in the case of a photosensitive material with a surface roughness of 0.07 μm, both glossiness and edge gradient were evaluated to be extremely excellent when the thickness of the ink ribbon evaporation layer was in the range of 100–2000 Angstrom. Further, in the case of a photosensitive material having a surface roughness of 0.10 μm, both glossiness and edge gradient were evaluated to be excellent when the thickness of the ink ribbon evaporation layer was in the range of 100–2000 Angstrom. Judging from the foregoing, it was found that high print quality can be maintained by controlling the surface roughness of a photosensitive material to at least 0.10 μm or less.

It was further evaluated that glossiness was poor in the case of a thickness of the ink ribbon evaporation layer of 80 Angstrom, and edge gradient was poor in the case of a thickness of 3000 Angstrom. Judging from the foregoing, it was found that high print quality can be maintained by controlling the thickness of the ink ribbon evaporation layer to 80–3000 (preferably 100–2000) Angstrom.

Though the invention has been explained as mentioned above, referring to the embodiment, the invention should not be construed to be limited to the embodiment, and it is naturally possible to take measures for modification/improvement according to circumstances. For example, the colorant layer can be made colorless and transparent or it can be omitted to obtain a color which is close to silver, although the colorant layer was caused to contain yellow dyes to obtain a color close to gold in the present embodiment. Further, the invention can be applied not only to a photosensitive material such as a photographic paper but also to an image forming medium having the surface roughness at a certain level or higher.

The image forming method of the invention having therein a step to detect edge portions of the image and split portions of the image, or split portions wherein the distance between them is not more than the width of the ink ribbon, a step to determine split portions for splitting where the image is to be split, based on the detected split portions, and a step to form an image located between the edge portion of the image and the split portion for splitting, or between the split portions for splitting through single scanning of the heating elements makes it possible to prevent spliced portions on an image to the utmost and thereby to maintain quality of images to be high even when images are formed through a plurality of scanning operations.

The image forming method of the invention has therein a step to split the image in the lateral direction to be of the length which is not more than the width of the ink ribbon when the length of the image in its lateral direction is longer than that of the ink ribbon; a step to form one of the split images at a time by moving the heating elements for scanning in the longitudinal direction of the image; a step to move the heating elements in the reverse direction by an amount of the aforesaid scanning; a step to shift the aforesaid photographic paper by a distance corresponding to the lateral length of one of the split images against the heating elements and ink ribbon stated above; and a step to form the succeeding one of the split images at a time by moving the heating elements in the longitudinal direction of the image. For example, in the case of forming an image which is long and slender like a character string when that image is paralleled to the ink ribbon for transferring, the total image can be formed through single scanning of heating elements, but low rate of utilization of the ink ribbon is feared. Therefore, when the image is split in its longitudinal direction to be within a width of the ink ribbon to conduct the transfer while shifting heating elements and the ink ribbon, the rate of utilization of the ink ribbon can be greatly improved.

What is claimed is:

1. An image forming apparatus, comprising:

a head, having a plurality of heating elements arranged in line, for forming an image on an image forming medium by transmitting ink, which an ink ribbon has, to said image forming medium;

a scanning means for moving said head in relation to said image forming medium;

an input means for inputting image data wherein said image data includes data corresponding to an image;

a searcher means for searching split lines of said image, according to said image data, so that a space between an edge portion of said image and a discontinued image portion on said image or between a discontinued image portion and its adjoining discontinued image portion is not more than a width of said ink ribbon; and a control means for controlling said head and said scanning means so that a portion of said image in said space, between an edge portion of said image and a discontinued image portion on said image or between a discontinued image portion and its adjoining discontinued image portion, is formed by one scanning path of said head.

2. The image forming apparatus of claim 1, wherein when plural discontinued image portions, with which a distance between an edge portion of said image and said discontinued image portion on said image or a distance between adjoining discontinued image portions is not more than a width of said ink ribbon, are obtained by said searcher means, said searcher means determines one of said plural discontinued image portions, with which said distance is closest to said width of said ink ribbon, as said split lines for splitting said image.

3. The image forming apparatus of claim 1, wherein said scanning means moves said head so that said heating element is prevented from exceeding edges of said image forming medium.

4. The image forming apparatus of claim 1, wherein said head forms said image by melting or softening at least a part of said ink ribbon, whereby said ink is transmitted onto said image forming medium.

5. The image forming apparatus of claim 4, wherein said ink ribbon has a metallic thin-film layer or a layer comprising metallic particles.

6. The image forming apparatus of claim 5, wherein said ink ribbon has said metallic thin-film layer formed by vapor deposition.

7. An image forming apparatus, comprising:

a head, having a plurality of heating elements arranged in line, for forming an image on an image forming medium by transmitting ink, which an ink ribbon has, to said image forming medium;

a scanning means for moving said head in relation to said image forming medium;

an input means for inputting image data wherein said image data includes data corresponding to an image;

a split means for splitting said image into partial images each of which has a horizontal length shorter than a width of said ink ribbon when a horizontal length of said image is longer than said width of said ink ribbon;

a control means for controlling said head and said scanning means so that each of said partial images is formed with one scanning path of said head; and a moving means for moving said image forming medium in a horizontal direction, in relation to said ink ribbon and said head, for a distance corresponding a horizontal length of each of said partial images.

8. The image forming apparatus of claim 7, wherein said scanning means moves said head in a longitudinal direction of said ink ribbon, in relation to said image forming medium, so that a moving direction of said head by said scanning means is substantially perpendicular to a moving direction of said image forming medium by said moving means.

9. The image forming apparatus of claim 7, wherein said split means split said image by obtaining split lines of said image, by which a space between an edge portion of said image and a discontinued image portion on said image or between a discontinued image portion and its adjoining discontinued image portion is made to be a width of said ink ribbon or less, and when a plurality of discontinued image portions are obtained by said split means, said split means determines one of said discontinued image portions, with which said distance is closest to said width of said ink ribbon as said split lines for splitting said image.

10. The image forming apparatus of claim 7, wherein said scanning means moves said head so that said plurality of heating elements are prevented from exceeding edges of said image forming medium.

11. The image forming apparatus of claim 7, wherein said head forms said image by melting or softening at least a part of said ink ribbon, whereby said ink is transmitted onto said image forming medium.

12. The image forming apparatus of claim 11, wherein said ink ribbon has a metallic thin-film layer or a layer comprising metallic particles.

13. The image forming apparatus of claim 12, wherein said ink ribbon has said metallic thin-film layer formed by vapor deposition.

14. An image forming method, comprising the steps of:

obtaining split lines of said image, according to image data, so that a space between an edge portion of said image and a discontinued image portion on said image or between a discontinued image portion and its adjoining discontinued image portion is not more than a width of said ink ribbon; and forming a portion of said image in said space, between an edge portion of said image and a discontinued image portion on said image or between a discontinued image portion and its adjoining discontinued image portion, by transmitting ink, which an ink ribbon has, to said image forming medium with one scanning path of a plurality of heating elements.

15. The image forming method of claim 14, wherein said step of obtaining split lines includes the steps of:

searching discontinued image portions of said image, according to image data, so that a space between an edge portion of said image and a discontinued image portion on said image or between a discontinued image portion and its adjoining discontinued image portion is not more than a width of said ink ribbon; and obtaining split lines for splitting said image in accordance with said discontinued image portions.

16. The image forming method of claim 14, wherein said step of obtaining said split lines of said image includes a step of:

determining a discontinued image portion, with which said distance is closest to said width of said ink ribbon, as one of said split lines for splitting said image when plural discontinued image portions, with which a distance between an edge portion of said image and said discontinued image portion on said image or a distance between adjoining discontinued image portions is not more than a width of said ink ribbon, are obtained.

17. The image forming apparatus of claim 14, wherein said head forms said image by melting or softening at least a part of said ink ribbon, whereby said ink is transmitted onto said image forming medium.

18. The image forming apparatus of claim 17, wherein said ink ribbon has a metallic thin-film layer or a layer comprising metallic particles.

19. The image forming apparatus of claim 18, wherein said ink ribbon has said metallic thin-film layer formed by vapor deposition.

20. The image forming method of claim 14, wherein the central surface roughness ($SR_n$) on an obverse side of said image forming medium where an image is formed is not more than 0.10 $\mu$m, and a thickness of said evaporated layer is not less than 100 Å.

21. The image forming method of claim 20 wherein said thickness of said evaporated layer is not more than 2000 Å.

22. The image forming method of claim 20, wherein said image forming medium is a silver halide photographic photosensitive material having at least one photosensitive layer and at least one nonsensitive layer on a reflection type support.

23. The image forming method claim 22, wherein an image is pre-formed on said photosensitive layer.

24. The image forming method of claim 20, wherein said ink ribbon composed at least of a base material, a coloring material layer, an evaporated layer and an adhesion layer.

25. The image forming method of claim 20, wherein said evaporated layer is made of aluminum and said coloring material layer has therein yellow coloring materials.

26. The image forming method of claim 20, wherein said evaporated layer is made of aluminum and said coloring material layer is made to be colorless.

27. The image forming method of claim 20, wherein said ink ribbon is composed at least of a base material, an evaporated layer and an adhesion layer.

28. The image forming method of claim 20, wherein said adhesion layer contains resins having therein a hydrophilic group.

29. An image forming method to transfer an image onto an image forming medium by splitting said image and at least partially melting or softening an ink ribbon, having an metallic thin-film layer or a layer comprising metallic particles, with scanning of a heating element formed in line, comprising the steps of:

splitting said image in a lateral direction into a length, which is not more than a width of said ink ribbon, when a length of said image in said lateral direction is longer than said width of said ribbon so that split images are obtained;

forming one of said split images at a time with scanning said heating element in the longitudinal direction of said image;

moving said heating element in a reverse direction of a normal scanning direction for an amount of said scanning in said forming step of one of said split images; and shifting said image forming medium for a length corresponding to one of said split images in relation to said heating element and said ink ribbon.

30. The image forming method of claim 29, wherein said ink ribbon has said metallic thin-film layer formed by vapor deposition.

31. The image forming method of claim 29, wherein said step to splitting said image includes a step of:

searching split lines so that a space between an edge portion of the image and a discontinued image portion on the image or between a discontinued image portion and its adjoining discontinued image portion is not more than said width of said ink ribbon; and splitting said image according to said split lines.

32. The image forming method of claim 31 wherein when plural discontinued image portions, with which a space between an edge portion of the image and a discontinued image portion on the image or between a discontinued image portion and its adjoining discontinued image portion is not more than said width of said ink ribbon, are searched in said step of splitting said image, said image is split at one of said discontinued image portions with which said space is closest to said width of said ink ribbon.

33. The image forming method of claim 29, wherein the central surface roughness ($SR_n$) on an obverse side of said image forming medium where an image is formed is not more than 0.10 $\mu$m, and a thickness of said evaporated layer is not less than 100 Å.

34. The image forming method of claim 33 wherein said thickness of said evaporated layer is not more than 2000 Å.

35. The image forming method of claim 33, wherein said image forming medium is a silver halide photographic photosensitive material having at least one photosensitive layer and at least one nonsensitive layer on a reflection type support.

36. The image forming method claim 35, wherein an image is pre-formed on said photosensitive layer.

37. The image forming method of claim 33, wherein said ink ribbon composed at least of a base material, a coloring material layer, an evaporated layer and an adhesion layer.

38. The image forming method of claim 33, wherein said evaporated layer is made of aluminum and said coloring material layer has therein yellow coloring materials.

39. The image forming method of claim 33, wherein said evaporated layer is made of aluminum and said coloring material layer is made to be colorless.

40. The image forming method of claim 33, wherein said ink ribbon is composed at least of a base material, an evaporated layer and an adhesion layer.

41. The image forming method of claim 33, wherein said adhesion layer contains resins having therein a hydrophilic group.

* * * * *